United States Patent [19]

Halme

[11] Patent Number: 4,915,026

[45] Date of Patent: Apr. 10, 1990

[54] ON-MACHINE CALENDER FOR A PAPER MACHINE WITH ELASTIC RESERVE ROLL

[75] Inventor: Matti Halme, Helsinki, Finland

[73] Assignee: Valmet Paper Machinery Inc., Finland

[21] Appl. No.: 278,438

[22] PCT Filed: Apr. 27, 1988

[86] PCT No.: PCT/FI88/00063

§ 371 Date: Nov. 21, 1988

§ 102(e) Date: Nov. 21, 1988

[87] PCT Pub. No.: WO88/08468

PCT Pub. Date: Nov. 3, 1988

[30] Foreign Application Priority Data

Apr. 28, 1987 [FI] Finland ..... 871871

[51] Int. Cl.[4] ..... D21G 1/00

[52] U.S. Cl. ..... 100/162 R; 100/161; 100/168; 100/176; 162/205; 162/272; 162/360.1

[58] Field of Search ..... 162/205, 206, 207, 360.1, 162/361, 272; 100/161, 162 R, 162 B, 163 R, 168, 176

[56] References Cited

U.S. PATENT DOCUMENTS

| | | | |
|---|---|---|---|
| 4,128,053 | 12/1978 | Kankaanpaa | 100/162 P |
| 4,211,165 | 7/1980 | Schill | 162/360.1 |
| 4,326,456 | 4/1982 | Kankaanpaa | 100/162 R |
| 4,375,188 | 3/1983 | Leiviska | 100/162 R |
| 4,492,612 | 1/1985 | Matarainer | 162/360.1 |
| 4,497,246 | 2/1985 | Pav et al. | 100/162 R |
| 4,534,829 | 8/1985 | Ahrweiler et al. | 162/360.1 |

*Primary Examiner*—Karen M. Hastings

*Attorney, Agent, or Firm*—Steinberg & Raskin

[57] ABSTRACT

Method and apparatus for the finishing of a fiber web (W) by means of an on-machine calender connected to a paper machine or the like. The calendering apparatus includes a first hard roll (1) and a second hard roll (2) which is at a distance from the first one, and at substantially the same horizontal level, and in addition at least two elastic rolls (3,4,5) mounted on bearings borne by movable support (9,10,11,12). The elastic rolls (3,5) define in a working position calendering nips with the hard rolls (1,2). A number of paper guiding rolls (6,7,8,9,10,11) lead the course ($W_{in} \rightarrow W_{out}$) of the web (W) through the calendering nips. The elastic rolls (3,4,5) have been arranged with respect to the hard rolls (1,2) so that the calendering nips ($N_1$, $N_{10}$, $N_{11}$, $N_2$, $N_{20}$, $N_{21}$) can be defined against the upper quadrant of the hard rolls (1,2) at substantially the same horizontal level with each other.

19 Claims, 3 Drawing Sheets

ON-MACHINE CALENDER FOR A PAPER MACHINE WITH ELASTIC RESERVE ROLL

BACKGROUND OF THE INVENTION

This invention relates to an on-machine calender which can be connected to a paper machine or the like for finishing treatment of a fiber web, which calder includes a first hard roll and a second hard roll at a distance from the first one and in addition at least two elastic rolls mounted on bearings in movable supporting means in a way which permits the elastic rolls to be moved into a working position so as to define calendering nips with the hard rolls and, in addition, a number of paper guiding rolls for leading the web run through said calendering nips.

Furthermore the invention relates to a method in an on-machine finishing treatment of a web-like material which treatment takes place in a calendering apparatus in which a first and a second hard roll and at least two elastic rolls are employed, the elastic ones being arranged so as to define calendering nips with said hard rolls which nips all are substantially at a same horizontal level and in which calender the hard rolls are substantially at a same horizontal level and in which the elastic rolls are, with respect to each other, substantially at a same horizontal level which is above that of the hard rolls.

An important stage in finishing treatment of the paper is its calendering by which an influence exerted on the smoothness and gloss of the surface of the paper and the thickness and the density of the paper. Calendering takes place while passing the continuous paper web through particular pressing points, or nips, formed between coacting calender rolls.

Conventionally the calendering of paper is effected by means of a so-called machine calender which is directly associated with the paper machine said calendering treatment being complemented, if necessary, by a supercalendering treatment in a separate so-called supercalender which gives the paper more gloss.

The rolls used in calenders are either hard or elastic rolls. By hard rolls are meant in this context rolls having a shell material of e.g. chill-cast iron or steel and of which the surface acting on the paper is ground glossy. A conventional machine calender has hard rolls only and the nips between them are so-called hard nips.

Elastic rolls refer in the following to rolls in which the surface acting on the surface of the web is of resilient material. This kind of rolls which are used in supercalenders define together with the hard rolls so-called soft nips.

As material for the mantles of the elastic rolls paper sheets are commonly used which are cut into disks, assembled as courses on the roll shaft and thereafter pressed in a direction parallel with the shaft into a solid, compact and quite thick covering of the rolls. Nowadays various plastic-based coverings are also used which are commonly relatively thin due to which it is possible to equip the body of the roll with internal deflection compensation means without increasing the diameter of the roll to an excessive extent.

As is known in the prior art, machine-calendering can also be carried out with a single-nip calender, that is with a calender in which only one pair of rolls defines a nip, depending on the brand of the paper to be treated and the requirements therein imposed. In most cases, however, a machine-calender includes four to eight rolls which thus define three to seven hard nips. As a result of the machinecalendering process the possible thick areas in the web are smoothed out so that the web achieves the required thickness, or the so-called caliper.

Conventionally, by means of a supercalender provided with soft nips only, it is usually attempted to achieve equal gloss for both sides of the web. This requires at least two soft nips and in addition arranged usually in such a way that both sides of the web will be against the surface of a hard roll in an equal number of nips which surface primarily gives gloss for the web. A separate supercalender may include as many as ten pairs of nips. As a result of supercalendering the web usually acquires even density and smoothness.

To boost the production of a paper machine it has been found necessary to attempt to accomplish such an immediately to a paper machine connected calender unit which combines the functions of both a machine-calender and a supercalender. Such calenders have been disclosed e.g. in U.S. Pat. Nos. 4,128,053; 4,332,191; and 4,375,118.

Although machine-calenders and supercalenders usually include eight to ten nips it has been found that even two soft nips alone can give the paper produced such a gloss and smoothness and/or additional properties which are sufficient for most purposes. This results from the fact that the paper coming from the paper machine to calendering treatment is in respect of its formation and fibre distribution usually considerably more even and can be thus more easily calendered than e.g. paper produced according to the technology in use of e.g. about twenty years ago due to the today's web-formation techniques and the control systems therein involved. The development on one hand in the materials for elastic coverings and on the other hand in the properties of the paper to be glazed which can be influenced by applying a thin layer of a suitable paste on the surface of the paper, or coating the semi-finished web e.g. at some stage of the drying in a paper machine, makes it possible to use calender structures which differ from and are even more simple than the previous ones.

The most generally accepted comprehension of the influence of the supercalendering on the web to be processed is that a higher gloss is produced on the surface facing the hard roll in the nip. There are, however, several factors which together affect the gloss and smoothness such as nip load, the possible difference in the rotation speeds of the elastic roll and the hard roll, and as an important factor, the material of the elastic covering. Development work is continuing, especially regarding the last-mentioned factor, and covering materials new and/or under development may give reason to revise theories about calendering.

SUMMARY OF THE INVENTION

This invention relates in particular to such on-machine combination calenders or machine-supercalenders in which there are two nips only in their most simple embodiments.

The object of this invention is to improve previously known so-called on-machine supercalenders connected to either paper machines or cardboard machines in which calenders there are at least two soft nips, meaning nips formed between an elastic roll and a hard roll by means of which a matt, so-called soft-gloss or -smoothness is obtained on the web.

An additional object of the invention is to provide a soft-calendering apparatus more simple than those previously known in which apparatus one of the elastic rolls which is damaged during the operation of the calender, or any function of said roll can, as quickly as possible, be replaced with a new one, in many cases during the continuous operation of the calender.

Furthermore, the object of the invention is to provide a softcalendering apparatus by means of which, if necessary, an intensified treatment may be induced on either one side of the fiber web.

Still one object of the invention is to provide a calender in which the nip pressures may be adjusted separately and independently of each other. A further additional object is to provide a calender which is structurally open in a way which makes it possible to place possible devices for spreading and damping the paper web and measuring its moisture in an advantageous way and, if necessary, even before each calendering nip. Another additional object is to provide a calender in which there is a possibility for tail threading by means of a rope carrier system known in itself.

To attain the above-mentioned aims and others, which will become apparent later on, the on-machine calender of the invention for finishing treatment of a fiber web is mainly characterized in that the hard rolls are at substantially the same horizontal level, and in that the elastic rolls are, with respect to each other, at the same horizontal level above that of the hard rolls.

The proceudre of the invention is for its part mainly characterized in that the paper web is treated in the calendering nips formed between the hard rolls and said elastic rolls so that in the first nip the lower side of the web faces the first hard roll and so that in the nip or nips in connection with the second hard roll the opposite side, that is, the upper side of the web, faces the hard roll.

The calendering nips are preferably defined against either upper quadrant of both hard rolls. Preferably, the nips are defined on the periphery of a hard roll, within an area the width or circumferential angle of which is about 30°-60° with respect to the horizontal level. The circumferential angle is more preferably about 40°-50° with respect to the horizontal level.

BRIEF DESCRIPTION OF THE DRAWINGS

In the following, the invention shall be described in detail, with reference being made to certain embodiment examples of the invention, presented in the figures of the attached drawing, to the details of which the invention is not strictly confined. In the drawings, FIG. 1 displays diagrammatically a calender roll group of the invention, which includes two hard rolls and three elastic rolls as a two-nip version, in which the middle one of its three elastic rolls acts as a reserve roll, and the course of the web through the roll group.

DESCRIPTION OF THE PREFERRED EMBODIMENTS

Figure 1:
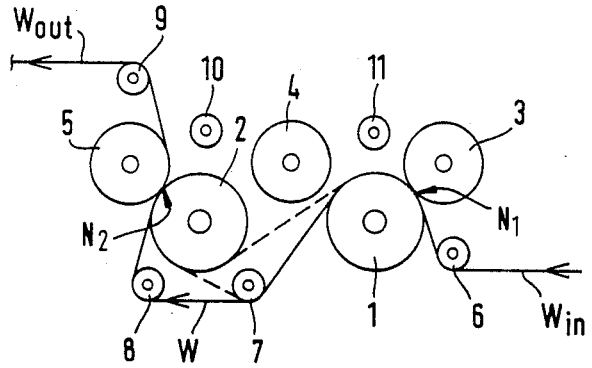
FIG. 1A displays an alternative course of the web, in accordance with a calender roll group shown in FIG. 1.

A diagrammatically depicted structure shown in FIG. 1, in which the passage, indicated by $W_{in}-W_{out}$, of the web W to be treated goes from right to left in the direction shown by the arrow, includes a first hard roll 1 and a second hard roll 2 and three elastic rolls 3,4 and 5 of which at least hard rolls 1,2 and advantageously also elastic rolls 3,4 and 5 are equipped with speed-controlled drive means. In addition to the working rolls defining calendering nips the calender includes a number of web-guiding rolls 6,7,8,9,10 and 11 by means of which the travel of the web W may be directed through calender nips $N_1$ and $N_2$ in a desired manner. The first elastic roll 3 in the travel of the web W defines a soft nip $N_1$ with the first hard roll 1, the calender being an on-machine calender. The web W coming from drying section of a paper machine or the like (not shown) is guided to this nip $N_1$ in such a way that makes the lower surface of the web W face the hard roll 1. The web W may flutter before the nip $N_1$ so as to cause wrinkling of the web. To avoid this and to restrain the fluttering, the guide roll 6 is placed so that the web W wraps the roll 1 before the nip $N_1$ in a sector of at least appr. 10° to 20°.

After the nip $N_1$ the web is transferred guided by the rolls 7 and 8 underneath the latter (i.e. second) hard roll 2 to the second nip $N_2$, defined between the elastic roll 5 and the second hard roll 2. In this nip in its turn the upper surface will face the hard roll. Thus both sides of the web W receive, in principle, the same kind of treatment, provided that the nip load is substantially the same in both nips. After the nip $N_2$ the travel of the web is passed via the guide roll 9 further to the reeling device which can be of the conventional Pope-type (not shown). What was presented above of restraining the fluttering of the web before the first calendering nip applies also in the case of the nip $N_2$ as well. Accordingly, the guide roll 8 is placed so that the web W wraps the roll 2 in a sector of at least appr. 10°-20° before the nip $N_2$.

The hard rolls 1 and 2 and also the elastic rolls 3,4 and 5 may be equipped with deflection compensation means known per se in the art and which rolls may be e.g. so-called Kusters-rolls. Deflection compensation is almost indispensable in both hard and elastic rolls at least in calenders of large working width. Narrow calenders can be without accomplished deflection compensation. As is well known, the rolls can be crowned instead, but in that case an even line pressure is achieved at a certain nip load only.

The elastic rolls 3 and 5 shown in FIG. 1 have been mounted on bearings in special supporting arms in the frame columns of the calender which are more in detail presented in FIG. 6 later on. The loading of rolls 3 and 5 against hard rolls 1 and 2 is effected by means of e.g. hydraulic working cylinders actuating the supporting arms by means of which the required nip pressure may be imposed. By means of the same working cylinders and supporting arms the rolls may also be completely released from nip contact e.g. in the start-up phase of the paper machine or in case of operational trouble in the threading of the web W.

Figure 6:
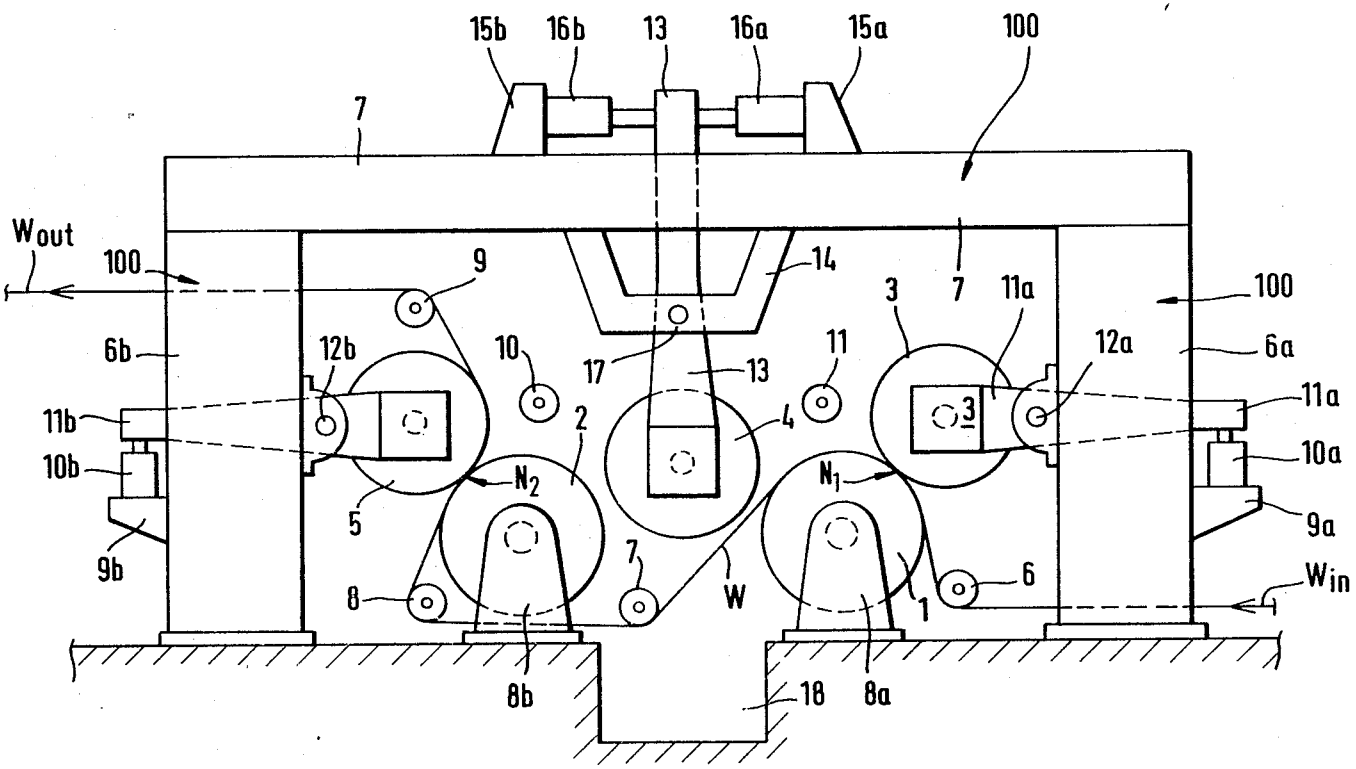
FIG. 6 shows, mainly according to FIG. 1, an on-machine calender with its frame structure and supporting means for the various rolls and loading means for the various nips.

In FIG. 1 the elastic roll 4, which is provided in the calender for serving as a reserve roll ready for use in the case that either one of the elastic rolls 3 or 5, would become damaged, has been mounted on bearings in a vertical supporting arm, as is presented in more detail in connection of FIG. 6. The roll 4, if necessary, can be quickly moved into nip contact with either the first hard roll 1 or the second hard roll 2.

Figure 1A:
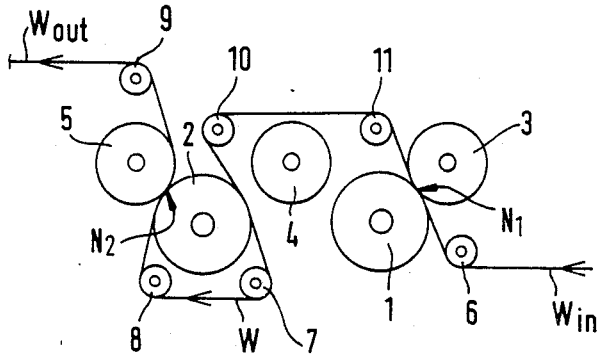

The roll combination and the calendering nip arrangement displayed in FIG. 1A is the same as the one shown in FIG. 1. What is different is however that threading of the web W is arranged to take place over the reserve roll 4, guided by the rolls 10 amd 11. According to this solution the length of the run of the web W between the nips $N_1$ and $N_2$ is increased to be about $1\frac{1}{2}$ times longer compared to that shown in FIG. 1, and it allows the width of the web W to increase freely in case the web W has been moisturized close to the nip $N_1$ (either before or after the nip) e.g. by water spraying or steam treatment (not shown) which can separately and adjustably be directed toward both the upper and lower surfaces so as to control the two-sidedness of the paper. That side of the web which is more uneven requires usually more effective moisturizing.

Figure 2:
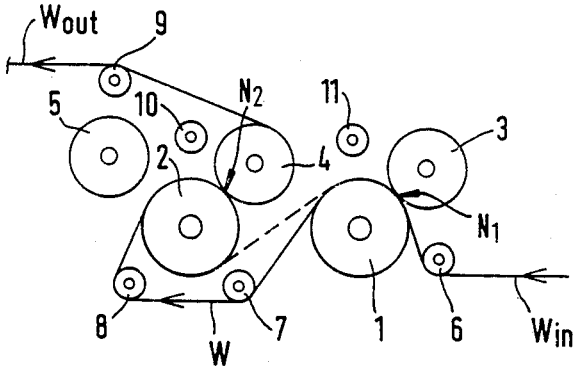
FIG. 2 displays diagrammatically the course of the web through a two-nip version of a calender roll group according to the invention in which version the elastic reserve roll has been moved so as to define a calendering nip with the latter hard roll in the direction of the web run.

According to FIG. 2, the third elastic roll 5 is shown as having been disconnected, e.g. for reparation, from nip contact with the hard roll 2 shown in FIG. 1 and the nip in question, nip $N_2$, has been replaced by the nip $N_2$ formed between roll 4 and roll 2. Also in this alternative nip $N_2$ the upper side of the web W will face a hard roll and the run of the web W through the calender and the treatment given to web W corresponds to that displayed in FIG. 1. In order to change the nip $N_2$ of FIG. 1 $\rightarrow N_2$ of FIG. 2, the web has to be guided counterclockwise around the roll 4. To make this possible either the web has to be cut purposely or alternatively the nip change may take place during such a production break that occasionally occurs in the normal operation of a paper machine.

Figure 3:
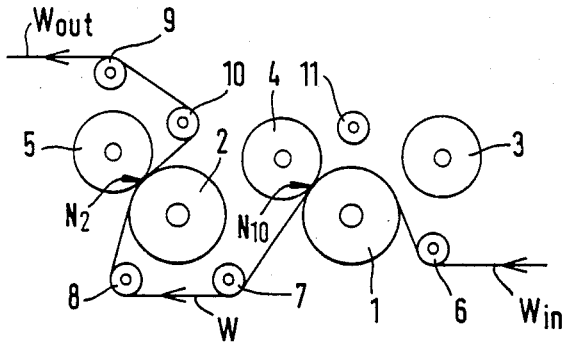
FIG. 3, correspondingly, displays a calender roll group of the invention as a two-nip application in which the elastic reserve roll defines a nip with the first hard roll in the direction of the web run.

According to FIG. 3, the first elastic roll 3 has been shown as having been disconnected from nip contact with the hard roll 1 e.g. for maintenance which nip $N_1$, has in this case been replaced by nip $N_{10}$ defined between the reserve roll 4 and the hard roll 1. This change of nip $N_1 \rightarrow N_{10}$ does not require any cutting of the web W and may therefore be effectd in various ways during the continuous run of the paper machine. One possibility is to move the roll 4 first to a working position, that is, into nip contact with the hard roll 1 which roll momentarily will be in contact with two elastic rolls 3 and 4. It is not necessary, however, to load these in full simultaneously, which arrangement may be accomplished by some automatic means known in the art. Immediately after the roll 4 has reached full load, or nip pressure in the nip $N_{10}$, the nip $N_1$ is opened after which the roll 3 may be demounted from its supporting arms for maintenance.

Figure 3A:
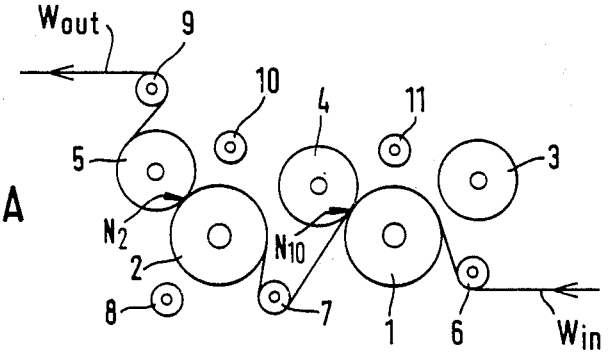
FIG. 3A displays an alternative passage of the web, in a calender roll group according to FIG. 2.

The roll combination and calendering nip arrangement displayed in FIG. 3A is the same as shown in FIG. 3. The difference is, however, that the web is led to the latter (second) calendering nip $N_2$ from an opposite direction compared to that shown in FIG. 3, which constructively requires changing the direction of rotation of the hard roll 2. Regarding the calendering procedure itself, the solution means that the lower surface of the web to be calendered receives an intensified treatment since it faces a hard roll in both the nips $N_1$ and $N_2$. This kind of treatment can come into question in cases when calendering a web made with a single-wire fourdrinier paper machine, in which cases the lower surface of the web may show occasionally a very heavy wire marking.

Figure 4:
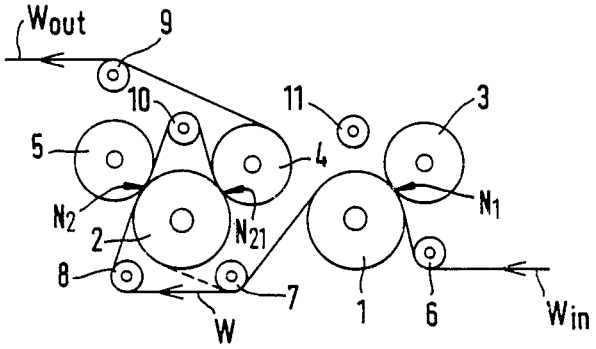
FIG. 4 displays the diagrammatically the passage of the web in a calender roll group of the invention in which the elastic reserve roll acts as an additional active roll against the latter hard roll; in this case the calender operates as a three-nip calender so that the upper surface of the web being calendered will face the same hard roll in the two last nips.

As shown in FIG. 4 the elastic rolls 4 and 5 operate simultaneously against the hard roll 2 so that in the nips $N_1$ and $N_{21}$ thereby defined the upper surface of the web W faces the hard roll 2 and obtains thus a higher gloss (ironing effect) than the lower surface which faces the elastic rolls 4 and 5. This function of the calender corresponds to the structure shown in FIG. 1 with the exception that the reserve roll 4 also is in this case in a working position. The course of the web W has to be guided around the roll 4 in the same way as in FIG. 2. This cannot be arranged during the continuous run of the calender but requires an either accidental or intentional break in production in order to move the reserve roll 4 from its rest position into a working position displayed in FIG. 4, and guiding the web accordingly.

FIG. 4 furthermore displays an in some cases favourable operational solution in which the web W is guided over a springy suspended additional roll 10 between the nips $N_2$ and $N_{21}$. The purpose of this arrangement is to eliminate the effects of the possible stretching of the web W between nips $N_2$ and $N_{21}$ which otherwise may result in wrinkling of the web in the nip $N_{21}$. It is not, however, necessary to lead the web in this way.

Figure 5:
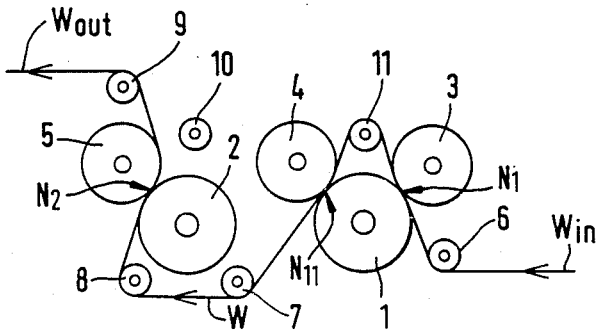
FIG. 5 displays a calender roll group of the invention in which the elastic reserve roll acts as an additional active roll against the first hard roll; the calender operates as a three-nip calender so that in this case the lower surface of the web faces the same hard roll consecutively in the first two nips.

Also in the structure displayed in FIG. 5, an intensified treatment of one side of the web is accomplished and in this case of the lower side. In this case, the elastic rolls 3 and 4 define two consecutive nips $N_1$ and $N_{11}$ with the first hard roll 1 so that the lower surface of the web W face the hard roll 1 and obtains a higher gloss onto its lower surface (ironing effect). Forming of consecutive nips $N_1$ and $N_{11}$ against the hard roll 1 is possible even during continuous operation by moving the roll 4 from its rest position against the roll 1. It is advantageous, however, in the same way as shown in FIG. 4, to arrange the course of the web W to be guided over an additional, flexibly supported spring roll 11 which eliminates the disturbing effect which is caused by the stretching of the web to the function of the calender between nips $N_1$ and $N_{11}$. A short production break in the operation of the calender is required also in this case for the re-threading of the web.

An intensified calendering treatment is usually applied to that surface of the web W which is more uneven caused by the function of the wet end of the paper machine. In manufacturing certain special paper brands, this intensified burnishing may be applied to the upper web surface which by nature is smoother than the lower wire side e.g. in paper made by a fourdrinier-machine.

FIG. 6 displays, in elevational view from the tending side, one frame structure of the calender of the invention including the supporting and loading means of the rolls thereof. The frame 100 of the calender consists of two vertical columns 6*a* and 6*b* and a connecting horizontal beam 7 therebetween. Corresponding beams and columns are on the drive side of the calender at a distance determined by the working width of the calender.

The hard rolls 1 and 2 included in the calender are mounted fixedly on bearings resting on supporting brackets 8a and 8b. Of the elastic rolls 3,4 and 5 of the calender the rolls 3 and 5 are mounted substantially on bearings on supporting arms 11a and 11b placed on vertical columns 6*a* and 6*b*. Opening and closing of the nip $N_1$ between the rolls 1 and 3, and the adjustment of corresponding nip load are effected by means of a working cylinder 10a resting on a console 9a which cylinder influences on the supporting arm 11a by turning it around the pivot shaft 12a. Correspondingly, the adjustment of operation and load of the nip $N_2$ between rolls 2 and 5 is effected by means of the supporting arm 11*b*. The elastic roll 4 provided for acting as a reserve roll is mounted on bearings on the substantially vertical supporting arm 13, the position and movement of which around the pivot point 17 is actuated by the working cylinders 16*a* and 16*b* which are supported by bracket means 15*a* and 15*b*. The working cylinders 16*a* and 16*b* are most appropriately hydraulically operated and with the aid of them the pendular movement of the supporting arm 13 is brought about so that the roll 4 may define nip $N_{10}$ (FIG. 3) either with roll 1 or nip $N_2$ (FIG. 2) with roll 2.

In the start-up phase, the web may arrive in the calender occasionally, irregularly wrinkled, and even in thick lumps. At this step the nips have to be open so that damage to the elastic rolls can be avoided. Threading the lead-in strip of the web can be done with a rope carrier system known in the art and the start-up phase continues until an even and uninterrupted run of the web has been established, whereafter the nips can be closed and loaded to a required extent.

Removal of the elastic rolls 3 and 5 can be done e.g. with the aid of roll changing device disclosed in the FI-patent No. 65462 of the applicant. For removing the roll 4 a recess 18 in the foundation of the calender is provided.

In FIGS. 1–5 the continuous lines represent various courses of the web through the calender of the invention. A common feature in several of these is the relatively long path of the web W from the first nip to the second one between the first and the second hard roll. Such a long path is of importance e.g. in case the web is moisturized in the region of the first nip. This results in the tendency of the web to become broader, which has to be allowed to take place freely and if possible, completely before the next nip.

If the web W is not moistened during the calendering, guiding of the web W may be realized following the shortest-way -principle of which some examples have been illustrated by the dotted lines in FIGS. 1,2 and 4. The choice of solution for guiding the web W through the nips of the calender depends e.g. on the paper brand and/or its possible coating and among other things on the running speed of the calender and applied nip pressures.

The inventive concept is described above, and various details of the invention may vary within the scope thereof.

I claim:

1. An on-machine calender which can be directly connected to a paper machine for finishing treatment of a fiber web, said calender including a first hard roll and a second hard roll substantially fixedly mounted on bearings at a distance from said first hard roll, at least first, second, and third elastic rolls mounted on bearings in movable support means, such that said elastic rolls can be arranged into working position so as to define calendering nips with said hard rolls, there being only said two hard rolls and said three elastic rolls in the calender for defining the calendering nips, and a plurality of guiding rolls which lead a run of a web through said calendering nips, wherein all said hard rolls are situated at substantially the same horizontal level, all said elastic rolls are situated at substantially the same horizontal level with respect to one another, and above said level of said hard rolls, said third elastic roll constitutes a reserve roll which is structured and arranged to be movable into nip contact with either of said first and second hard rolls and is situated between said first and second elastic rolls, and said support means for said third elastic roll comprises a turnable supporting arm upon which said third elastic or reserve roll is mounted, arranged to support said third elastic or reserve roll substantially vertically from above, said arm pivotally mounted for pendular movement, and force means for moving said arm, and in turn said third elastic or reserve roll, in order to achieve loading of a respective nip with said reserve roll.

2. The combination of claim 1, wherein said calendering nips are defined against upper quadrants of said hard rolls.

3. The combination of claim 2, wherein said nips are each defined on a periphery of a respective hard roll within a sector or circumferential angle of about 30°–60° with respect to said horizontal level of said hard rolls.

4. The combination of claim 3, wherein said sector or circumferential angle is about 40°–50°.

5. The combination of claim 1, wherein said first elastic roll is arranged to define one of said nips against said first hard roll, said second elastic roll is arranged to define one of said nips against said second hard roll.

6. The combination of claim 1, wherein said first elastic roll defines one of said nips against said first hard roll, and said third elastic roll defines one of said nips against said second hard roll, when said second elastic roll is out of nip contact with any other roll.

7. The combination of claim 1, wherein sad second elastic roll is arranged to define one of said nips with said second hard roll, and said third elastic roll is arranged to define one of said nips with said first hard roll, when said first elastic roll is out of nip contact with any roll.

8. The combination of claim 1, wherein said first elastic roll is arranged to define one of said nips with said first hard roll, and said second and third elastic rolls are both arranged to simultaneously define nips with said second hard roll.

9. The combination of claim 1, wherein said guiding rolls are arranged to define said run of the web through said calender in a manner such that a lower surface of the web comes into initial contact with said first hard roll in said calender.

10. The combination of claim 1, wherein said first and third elastic rolls are both arranged to simultaneously define nips with said first hard roll, and said second elastic roll is arranged to define one of said nips with said second hard roll.

11. The combination of claim 1, wherein said first elastic roll is arranged to define one of said nips against said first hard roll, said second elastic roll is arranged to define one of said nips against said second hard roll, and said third elastic roll is arranged below the run of the paper web between said respective nips.

12. The combination of claim 7, wherein said elastic rolls and hard rolls are arranged to define said run of said web through said calender such that a lower surface of said web comes into contact with both said hard rolls along said run.

13. The combination of claim 5, wherein both said hard rolls are substantially fixedly mounted upon bearings at said distance from one another.

said movable support means for said first and second elastic rolls comprise a pivotally-mounted supporting arm upon which a respective elastic roll is mounted, and a cylinder arranged to pivot said respective arm, and said force means for said third elastic roll additionally comprise a cylinder arranged to pivot said turnable supporting arm on which said third elastic or reserve roll is supported for pendular movement.

14. The combination of claim 1, wherein said elastic and hard rolls are arranged such that all nips are at substantially the same horizontal level.

15. The combination of claim 1, wherein said calender is only constituted by two or three nips.

16. The combination of claim 1, comprising only up to six guiding rolls.

17. The combination of claim 1, wherein said guide rolls are arranged such that the run of said web through said calender passes directly from said first hard roll to said second hard roll, without passing around any guide rolls.

18. The combination of claim 1, wherein said guide rolls are arranged in said calender such that said run of said web from said first hard roll to said second hard roll just passes around only one guide roll.

19. The combination of claim 1, wherein said guide rolls are arranged in said calender such that the run of said web from said first hard roll to said second hard roll passes around two guide rolls.

* * * * *